US005469826A

United States Patent [19]

Thomas et al.

[11] Patent Number: 5,469,826

[45] Date of Patent: Nov. 28, 1995

[54] METHOD OF LOAD AND SPEED MODIFYING ON FUEL LEAN-OUT FOR INTERNAL COMBUSTION ENGINES

[75] Inventors: Christopher P. Thomas, Rochester Hills; Gregory T. Weber, Commerce Twp.; Glen E. Tallarek, Grosse Pointe Woods, all of Mich.

[73] Assignee: Chrysler Corporation, Highland Park, Mich.

[21] Appl. No.: 238,122

[22] Filed: May 4, 1994

[51] Int. Cl.[6] ..... F02D 41/12

[52] U.S. Cl. ..... 123/488; 123/493

[58] Field of Search ..... 123/493, 488, 123/480, 486

[56] References Cited

U.S. PATENT DOCUMENTS

| | | | |
|---|---|---|---|
| 3,916,170 | 10/1975 | Norimatsu et al. | 123/493 |
| 3,960,120 | 6/1976 | Aono et al. | 123/488 |
| 4,010,717 | 3/1977 | Taplin | 123/496 |
| 5,001,656 | 3/1991 | Zimmerman et al. | 364/557 |
| 5,003,944 | 4/1991 | Moote et al. | 123/299 |
| 5,003,952 | 4/1991 | Weglarz et al. | 123/478 |
| 5,003,953 | 4/1991 | Weglarz et al. | 123/478 |
| 5,113,827 | 5/1992 | Vincent | 123/417 |
| 5,197,433 | 3/1993 | Dykstra et al. | 123/184.55 |
| 5,235,946 | 8/1993 | Fodale et al. | 123/339 |
| 5,363,826 | 11/1994 | Takaoka | 123/486 |

*Primary Examiner*—Andrew M. Dolinar
*Attorney, Agent, or Firm*—Mark P. Calcaterra

[57] ABSTRACT

A method of load and speed modifying on fuel lean-out for an internal combustion engine includes the steps of sensing a speed of the engine, determining an engine speed modifier as a function of current sensed engine speed, sensing a manifold absolute pressure (MAP) of an intake manifold of the engine, determining an engine load modifier as a function of current sensed MAP, adding the determined engine speed modifier and engine load modifier together to yield a speed/load modifier, and applying the speed/load modifier value to a fuel pulsewidth value of fuel injectors for the engine and reducing the amount of fuel injected into the engine by the fuel injectors.

6 Claims, 6 Drawing Sheets

METHOD OF LOAD AND SPEED MODIFYING ON FUEL LEAN-OUT FOR INTERNAL COMBUSTION ENGINES

BACKGROUND OF THE INVENTION

1. Field of the Invention

The present invention relates generally to internal combustion engines in automotive vehicles and, more particularly, to methods of fuel lean-out for an internal combustion engine in an automotive vehicle.

2. Description of the Related Art

Today in automotive vehicles, some automotive vehicle manufacturers use "port-injected" internal combustion engines in their vehicles. In the port-injected engine, a fuel injector sprays fuel into air in an intake manifold of the engine near an intake valve of a cylinder of the engine as the air gets pulled into the cylinder during the cylinder's intake stroke. One problem with fuel delivery to all engines is that some of the fuel remains outside of the cylinder and either remains suspended in charge air or adheres to walls of the intake manifold (i.e., wall wetting). The amount of fuel that ends up adhering to the walls depends on parameters such as manifold temperature, charge temperature, rate of mass airflow, and manifold absolute pressure.

In a deceleration event of the port-injected engine, the manifold absolute pressure and airflow drop, "liberating" fuel from the walls of the intake manifold (i.e., the fuel vaporizes and is transported into the cylinders). Because of this liberation, the amount of fuel delivered by the fuel injectors into the cylinders of the engine must be less than the amount required for stoichiometric balance (i.e., the fuel injection system must be "leaned-out").

Previously, some automotive vehicle manufacturers have used fuel lean-out during deceleration of their port-injected engines. However, these deceleration fuel lean-out features made no distinction between deceleration events of differing severity. As a result, small tip-outs (.i.e., small decreases in throttle openings) could yield relatively poor driveability (due to excessive lean-out) and large tip-outs could yield relatively large hydrocarbon (HC) emissions (due to inadequate lean-out). Further, tip-in transitions from a deceleration event could have inconsistent performance characteristics on the engine depending on what "kind" of deceleration was being exited.

Another problem with all engines is that the throttle position is an inadequate indicator of the airflow into the engine. The throttle position is not linearly related to airflow and, therefore, is difficult to calibrate accurately. A further problem with all engines is that the enrichment required by the engines is different for different speeds and loads.

Additionally, on a "cold start" of the engine (before a catalyst of an exhaust system for the vehicle has had a chance to warm up and become fully active), unburned "long-chained" hydrocarbons (HC) block local oxidation sites on the catalyst, often smothering conversion. This smothering of conversion sites inhibits catalyst "light-off", delaying HC, CO and $NO_x$ conversion. The result is lower conversion efficiencies and higher undesirable emissions over a drive cycle of the vehicle.

SUMMARY OF THE INVENTION

It is, therefore, one object of the present invention to provide a method of proportional deceleration fuel lean-out for an internal combustion engine.

It is another object of the present invention to provide a method of proportional deceleration fuel lean-out for port-injected engines which makes the amount of fuel lean-out proportional to the severity of the deceleration event.

It is yet another object of the present invention to provide a method of throttle fuel lean-out for port-injected engines.

It is still another object of the present invention to provide a method of load and speed modifying on fuel lean-out for port-injected engines.

It is a further object of the present invention to provide a method of catalyst purge fuel lean-out for port-injected engines.

It is a still further object of the present invention to provide a method of catalyst purge fuel lean-out which provides extra oxygen in an exhaust of a port-injected engine.

To achieve the foregoing objects, the present invention are methods of fuel lean-out for an internal combustion engine. A method of load and speed modifying on fuel lean-out for an internal combustion engine includes the steps of sensing a speed of the engine, determining an engine speed modifier as a function of current sensed engine speed, Sensing a manifold absolute pressure (MAP) of an intake manifold of the engine, determining an engine load modifier as a function of current sensed MAP, adding the determined engine speed modifier and engine load modifier together to yield a speed/load modifier, and applying the speed/load modifier value to a fuel pulsewidth value of fuel injectors for the engine and reducing the amount of fuel injected into the engine by the fuel injectors.

One advantage of the present invention is that a method of proportional deceleration fuel lean-out is provided for an internal combustion engine. Another advantage of the present invention is that the method makes the amount of fuel lean-out proportional to the severity of the deceleration event. Yet another advantage of the present invention is that a method of throttle fuel lean-out is provided to approximate a linear relationship with the throttle position, allowing easier calibration. Still another advantage of the present invention is that the method allows a more accurate prediction in the change in engine airflow, making the prediction of fueling requirements based on the throttle position more accurate and reducing emissions. A further advantage of the present invention is that a method of load and speed modifiers on fuel lean-out is provided, allowing the engine to remain at stoichiometric and reducing emissions. Yet a further advantage of the present invention is that a method of catalyst purge fuel lean-out is provided for an internal combustion engine. A still further advantage of the present invention is that the method of catalyst purge fuel lean-out provides extra oxygen in the exhaust of the engine which helps oxidize "long-chained" HCs in the catalyst more quickly. An additional advantage of the present invention is that the method of catalyst purge fuel lean-out provides a more "aggressive" deceleration fuel lean-out for the first few minutes after a cold start of the engine.

Other objects, features and advantages of the present invention will be readily appreciated as the same becomes better understood after reading the subsequent description taken in conjunction with the accompanying drawings.

BRIEF DESCRIPTION OF THE DRAWINGS

FIGS. 2 through 7 are flowcharts of methods of fuel lean-out, according to the present invention, for the electronic fuel injection system and internal combustion engine of FIG. 1.

DESCRIPTION OF THE PREFERRED EMBODIMENT(S)

Figure 1:
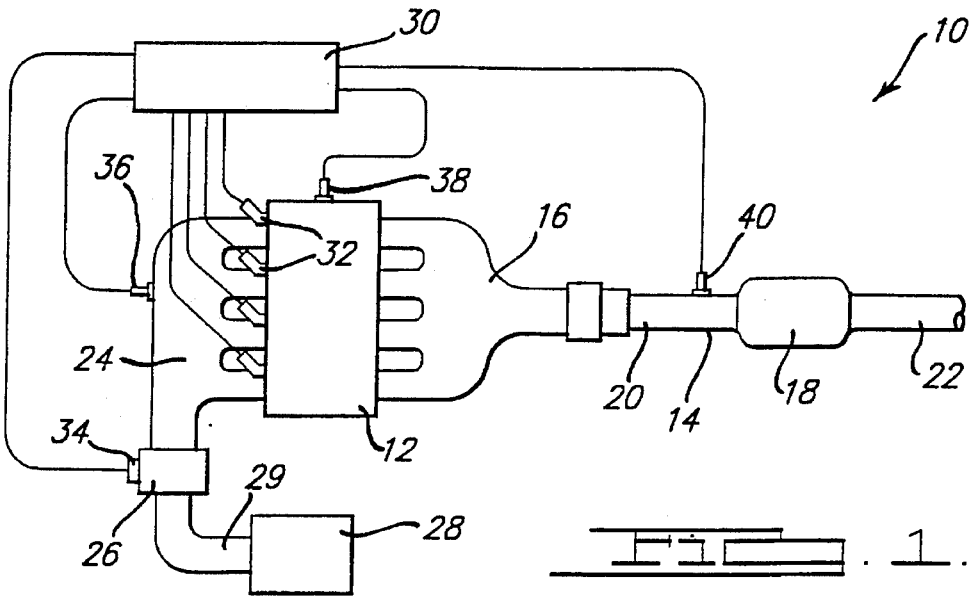
FIG. 1 is a schematic diagram of an electronic fuel injection system illustrated in operational relationship with an internal combustion engine and exhaust system of an automotive vehicle.

Referring to FIG. 1, an electronic fuel injection system 10, according to the present invention, is illustrated in operational relationship with an internal combustion engine 12 and an exhaust system 14 of an automotive vehicle (not shown). The exhaust system 14 includes an exhaust manifold 16 connected to the engine 12 and a catalyst 18 such as a catalytic converter connected by an upstream conduit 20 to the exhaust manifold 16. The exhaust system 14 also includes a downstream conduit 22 connected to the catalyst 18 and extending downstream to a muffler (not shown).

The engine 12 is a port-injected engine. The engine 12 includes an intake manifold 24 connected thereto and a throttle body 26 connected to the intake manifold 24. The engine 12 also includes an air filter 28 connected by a conduit 29 to the throttle body 26. It should be appreciated that the engine 12 and exhaust system 14 are conventional and known in the art.

The electronic fuel injection system 10 includes an engine controller 30 having fuel injector outputs 32 connected to corresponding fuel injectors (not shown) of the engine 12. The fuel injectors meter an amount of fuel to cylinders (not shown) of the engine 12 in response to a pulsewidth value sent by the engine controller 30 across the fuel injector outputs 32. The electronic fuel injection system 10 also includes a throttle position sensor 34 connected to the throttle body 26 and the engine controller 30 to sense an angular position of a throttle plate (not shown) in the throttle body 26. The electronic fuel injection system 10 includes a manifold absolute pressure (MAP) sensor 36 connected to the intake manifold 24 and the engine controller 30 to sense MAP. The electronic fuel injection system 10 also includes a coolant temperature sensor 38 connected to the engine 12 and the engine controller 30 to sense a temperature of the engine 12. The electronic fuel injection system 10 further includes an $O_2$ sensor 40 connected to the upstream conduit 20 of the exhaust system 14. The $O_2$ sensor 40 is also connected to the engine controller 30 to sense the $O_2$ level in the exhaust gas from the engine 12. It should be appreciated that the engine controller 30 and sensors 34,36,38 and 40 are conventional and known in the art.

Figure 2:
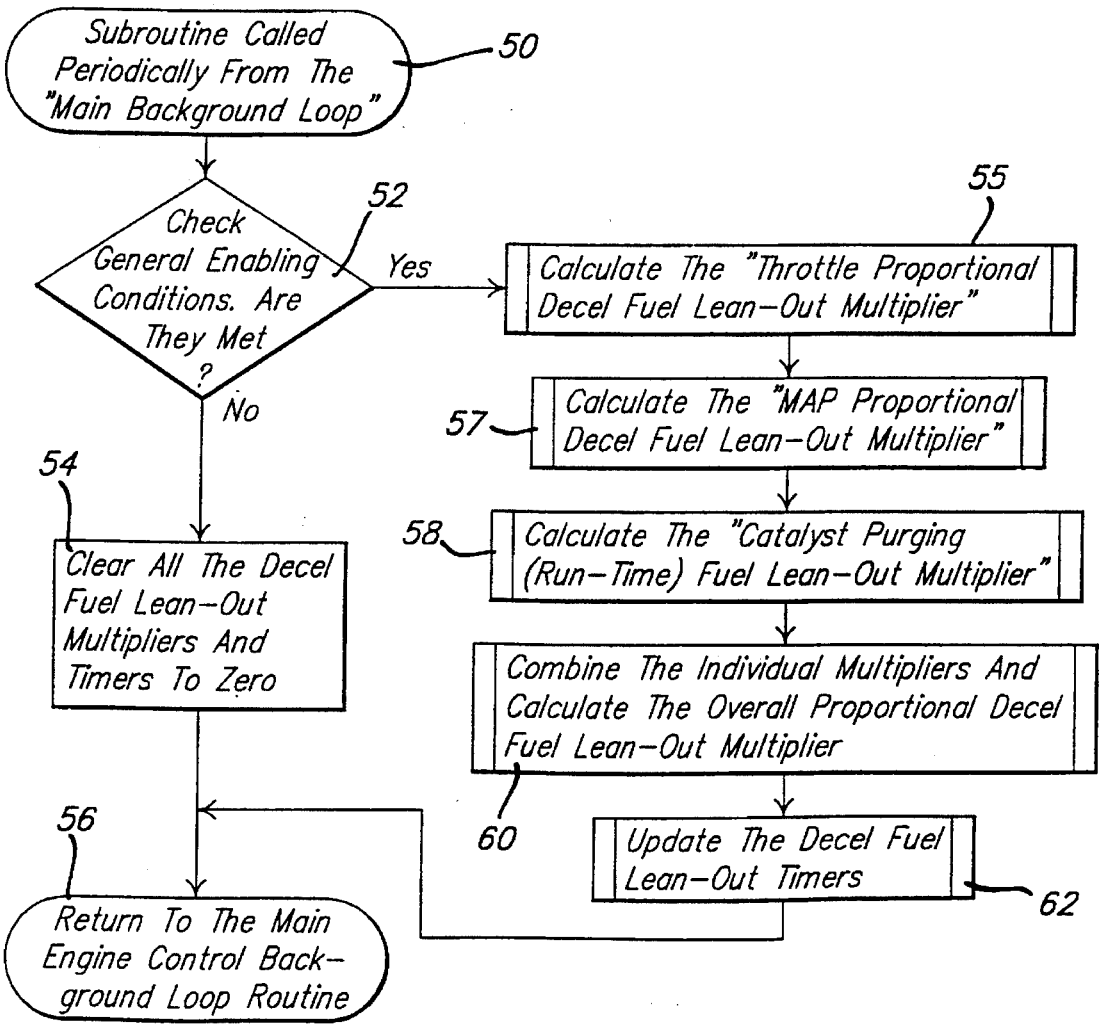

Referring to FIGS. 2 through 7, methods of fuel lean-out, according to the present invention, for the electronic fuel injection system 10 and engine 12 are shown. As illustrated in FIG. 2, a method of proportional deceleration fuel lean-out, according to the present invention, is shown. The methodology begins in bubble 50 and is called periodically from a main engine control background loop routine (not described). From bubble 50, the methodology advances to diamond 52 and checks general enabling conditions and determines whether these conditions are met. For example, the engine controller 30 checks the current vehicle speed from a vehicle speed sensor (not shown) and determines whether it is greater than or equal to a calibratable or predetermined minimum value stored in memory of the engine controller 30. For another example, the engine controller 30 checks the time since the engine 12 went through start-to-run transfer and determines whether it is greater than a predetermined time value such as 2.75 seconds. If the general enabling conditions are not met, the methodology advances to block 54 and clears all of the fuel lean-out multipliers and timers to be described to zero (0). The methodology then advances to bubble 56 and returns to the main engine control background loop routine.

Figure 3:
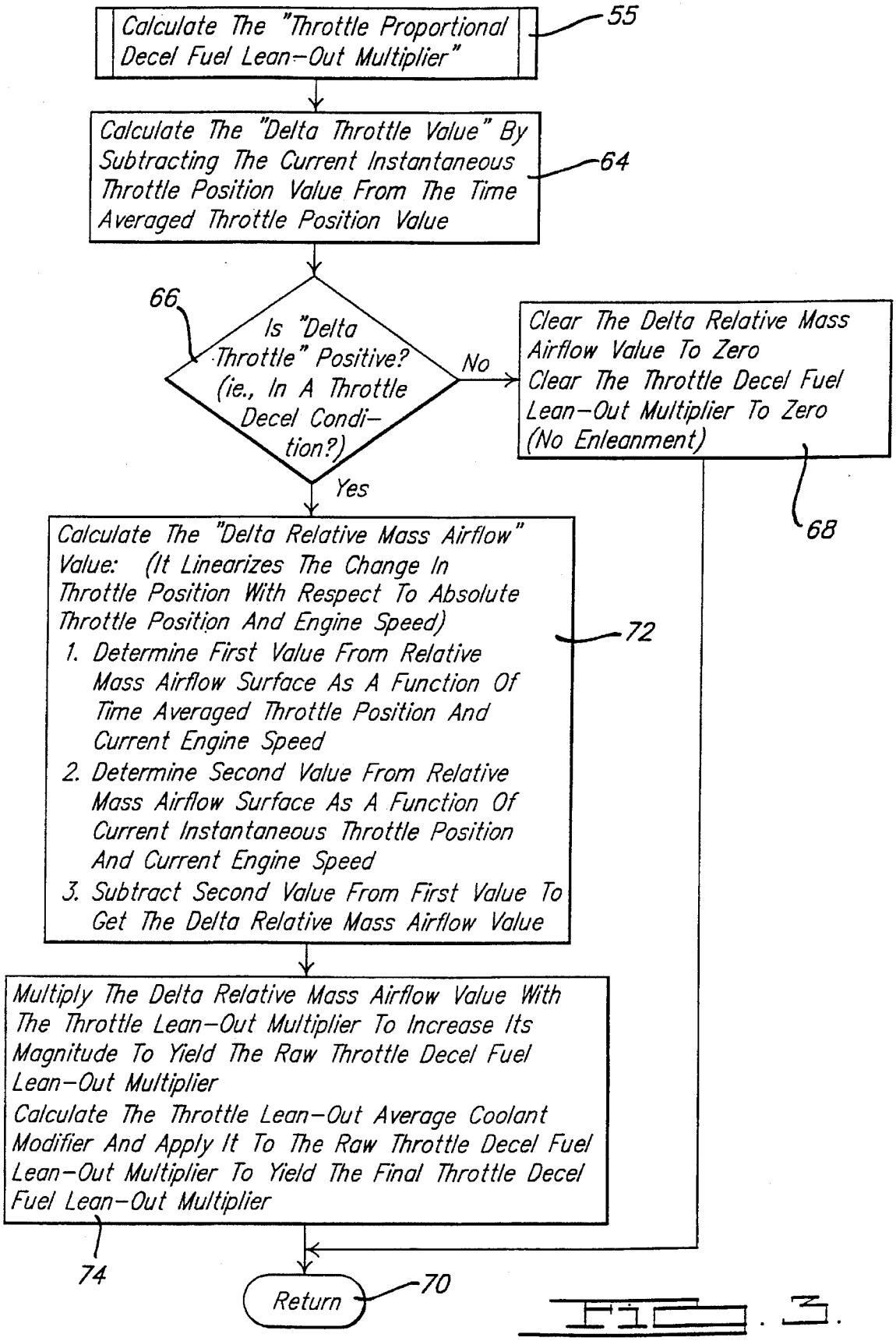

In diamond 52, if the general enabling conditions are met, the methodology advances to block 55 and calculates a throttle proportional deceleration fuel lean-out multiplier to be described in FIG. 3. After block 55, the methodology advances to block 57 and calculates a MAP proportional deceleration fuel lean-out multiplier to be described in FIG. 4. After block 57, the methodology advances to block 58 and calculates a catalyst purging (run-time) fuel lean-out multiplier to be described in FIGS. 5 and 6. After block 58, the methodology advances to block 60 and combines the above-described individual multipliers from blocks 55, 57 and 58 and calculates an overall proportional deceleration fuel lean-out multiplier to be described in FIG. 7. The methodology then advances to block 62 and updates deceleration fuel lean-out timers in the engine controller 30. The methodology advances to bubble 56 previously described.

As illustrated in FIG. 3, a method of throttle fuel lean-out, according to the present invention, is shown. The method is used to approximate a linear relationship with the throttle position, allowing easier calibration. The method uses an averaging technique and the critical throttle as a maximum throttle position which allows the assumption of a linear relationship for the difference between the instantaneous throttle position and the average throttle position.

The method involves calculating the throttle proportional deceleration fuel lean-out multiplier of block 55. In block 55, the methodology advances to block 64 and calculates a delta throttle value by subtracting a current instantaneous throttle position value as sensed by the throttle position sensor 34 from a time averaged throttle position value as determined by the engine controller 30 based on signals from the throttle position sensor 34 over time. The methodology advances to diamond 66 and determines whether the delta throttle value is positive (i.e., in a throttle deceleration condition). If not, the methodology advances to block 68 and clears a delta relative mass airflow value to zero (0) and clears the throttle deceleration fuel lean-out multiplier to zero (i.e., no enleanment). The methodology then advances to bubble 70 and returns to the block 56 in FIG. 2.

In diamond 66, if the delta throttle value is positive, the methodology advances to block 72 and calculates the delta relative mass airflow value which linearizes the change in throttle position with respect to absolute throttle position and engine speed. In block 72, the methodology determines a first value from a relative mass airflow surface stored in memory of the engine controller 30 as a function of the time averaged throttle position from the throttle position sensor 34 and current engine speed from a crankshaft sensor (not shown). The methodology also determines a second value from the relative mass airflow surface as a function of current instantaneous throttle position and current engine speed. The methodology further subtracts the second value from the relative mass airflow surface from the first value from the relative mass airflow surface to get the delta relative mass airflow (DRMAF) value.

After block 72, the methodology advances to block 74 and multiplies the delta relative mass airflow value with a predetermined throttle lean-out multiplier stored in memory of the engine controller 30 to increase its magnitude to yield a raw throttle deceleration fuel lean-out multiplier value. The methodology also calculates a throttle lean-out average coolant modifier value by interpolating a percentage value from a calibratable table stored in memory of the engine controller 30 using an average coolant temperature value from the coolant temperature sensor 38. The methodology multiplies the raw throttle deceleration fuel lean-out multiplier value by the throttle lean-out average coolant modifier value to yield the final throttle deceleration fuel lean-out multiplier value. The methodology then advances to bubble 70 previously described. It should be appreciated that the final throttle deceleration fuel lean-out multiplier value is applied to the fuel pulsewidth value to reduce the amount of fuel injected by the fuel injectors into the engine 12.

Figure 4:
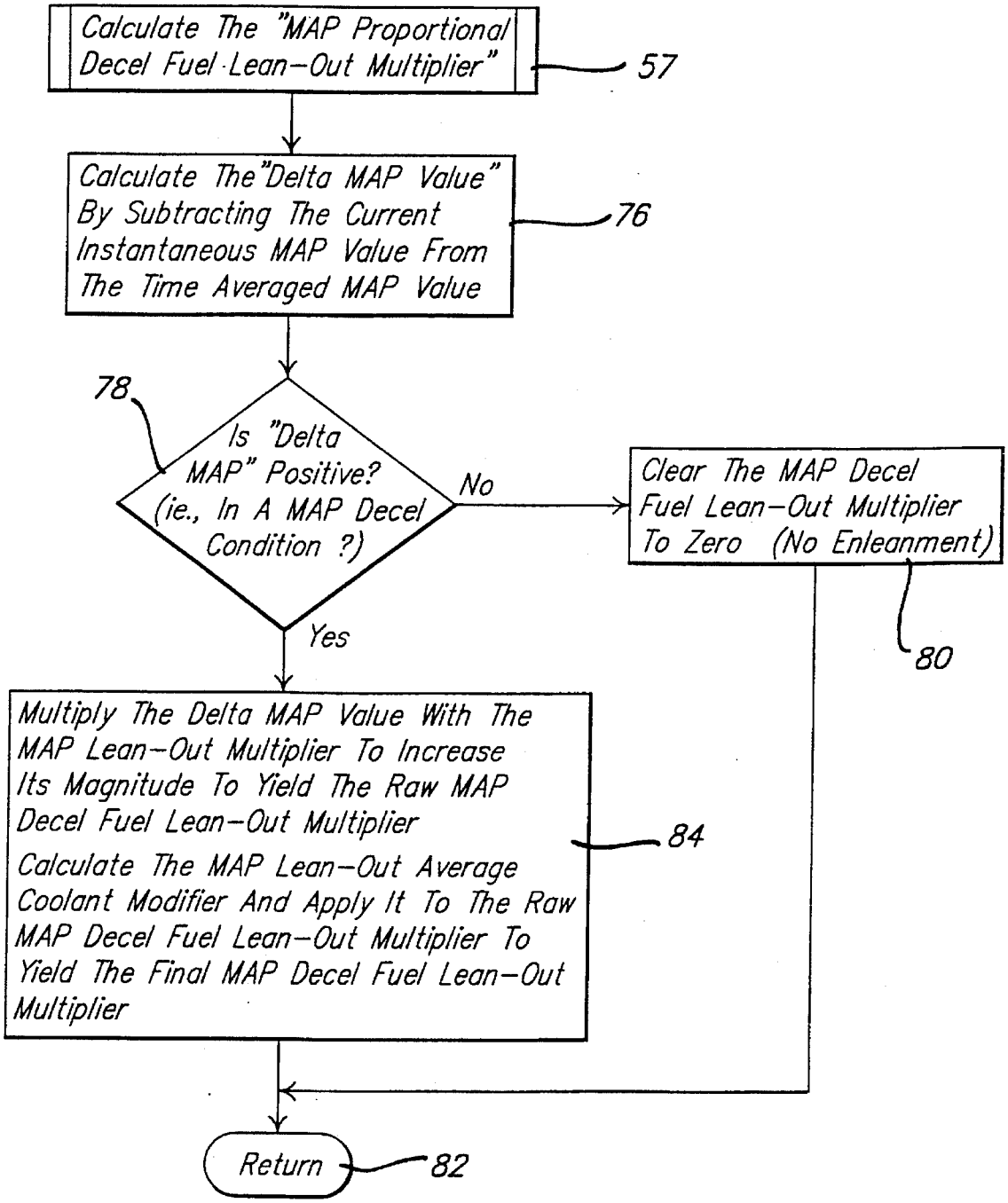

As illustrated in FIG. 4, a method of MAP fuel lean-out, according to the present invention, is shown. The method uses a relative mass airflow surface created by engine speed and a linearized current throttle position. The method also uses an instantaneous relative mass airflow and an average relative mass airflow to make a more accurate prediction in the change in engine airflow.

The method involves calculating the MAP proportional deceleration fuel lean-out multiplier of block 57. In block 57, the methodology advances to block 76 and calculates a delta MAP value by subtracting a current instantaneous MAP value as sensed by the MAP sensor 36 from a time averaged MAP value determined by the engine controller 30 based on signals from the MAP sensor 36 over time. The methodology then advances to diamond 78 and determines whether the deceleration fuel lean-out multiplier value is positive (i.e., in a MAP deceleration condition). If not, the methodology advances to block 80 and clears the MAP deceleration fuel lean-out multiplier to zero (0) (i.e., no enleanment). The methodology then advances to bubble 82 and returns to block 58 of FIG. 2.

In diamond 78, if the DMAP value is positive, the methodology advances to block 84 and multiplies the deceleration fuel lean-out multiplier value with a predetermined MAP lean-out multiplier stored in memory of the engine controller 30 to increase its magnitude to yield a raw MAP deceleration fuel lean-out multiplier value. The methodology also calculates a MAP lean-out average coolant modifier value by interpolating a percentage value from a calibratable table stored in memory of the engine controller 30 using an average coolant temperature value from the coolant temperature sensor 38. The methodology multiplies the raw MAP deceleration fuel lean-out multiplier value by the MAP lean-out average coolant modifier value to yield the final MAP deceleration fuel lean-out multiplier value. The methodology then advances to bubble 82 previously described. It should be appreciated that the final MAP deceleration fuel lean-out average coolant modifier value value is applied to the fuel pulsewidth value to reduce the amount of fuel injected by the fuel injectors into the engine 12.

Figure 5:
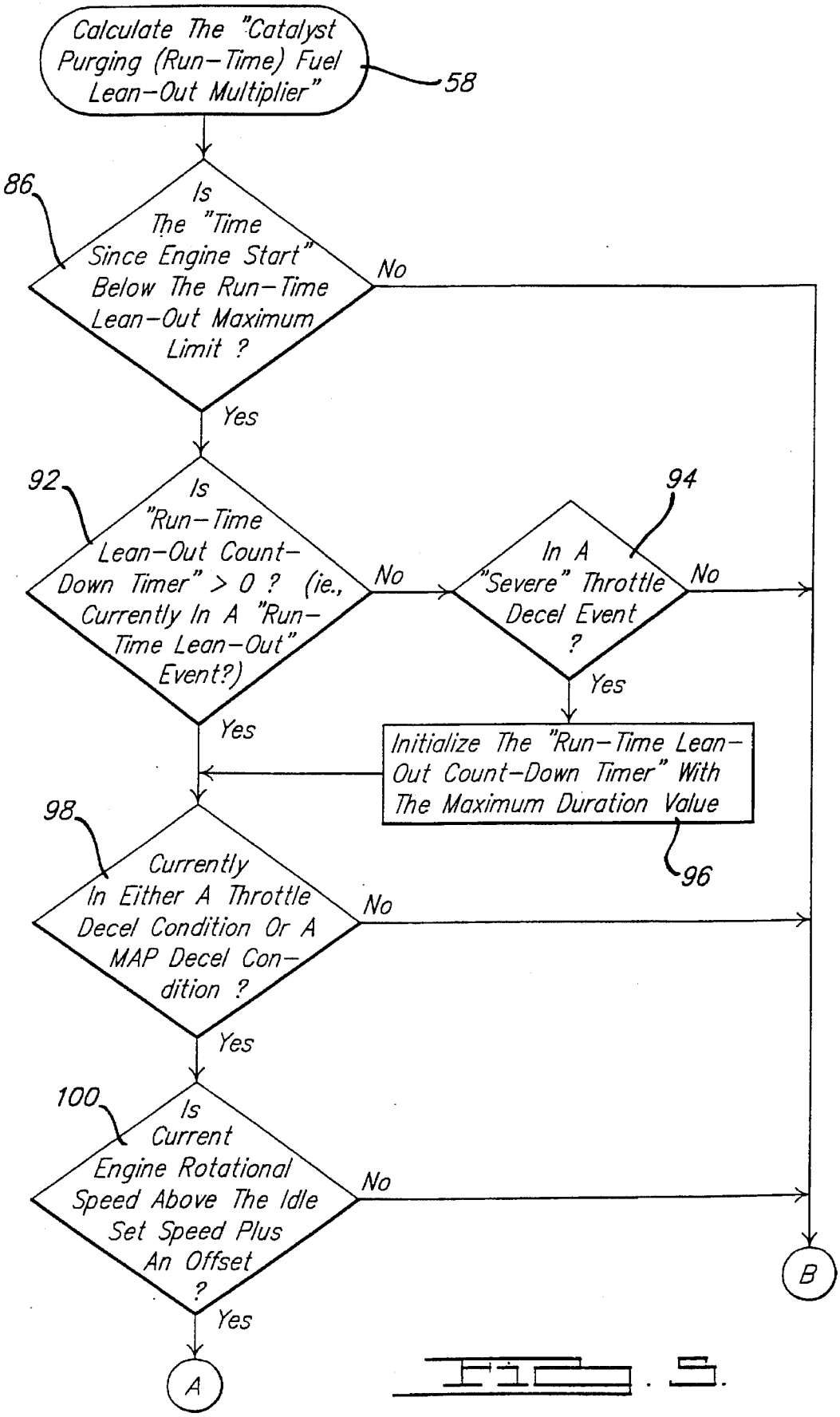
Figure 5:
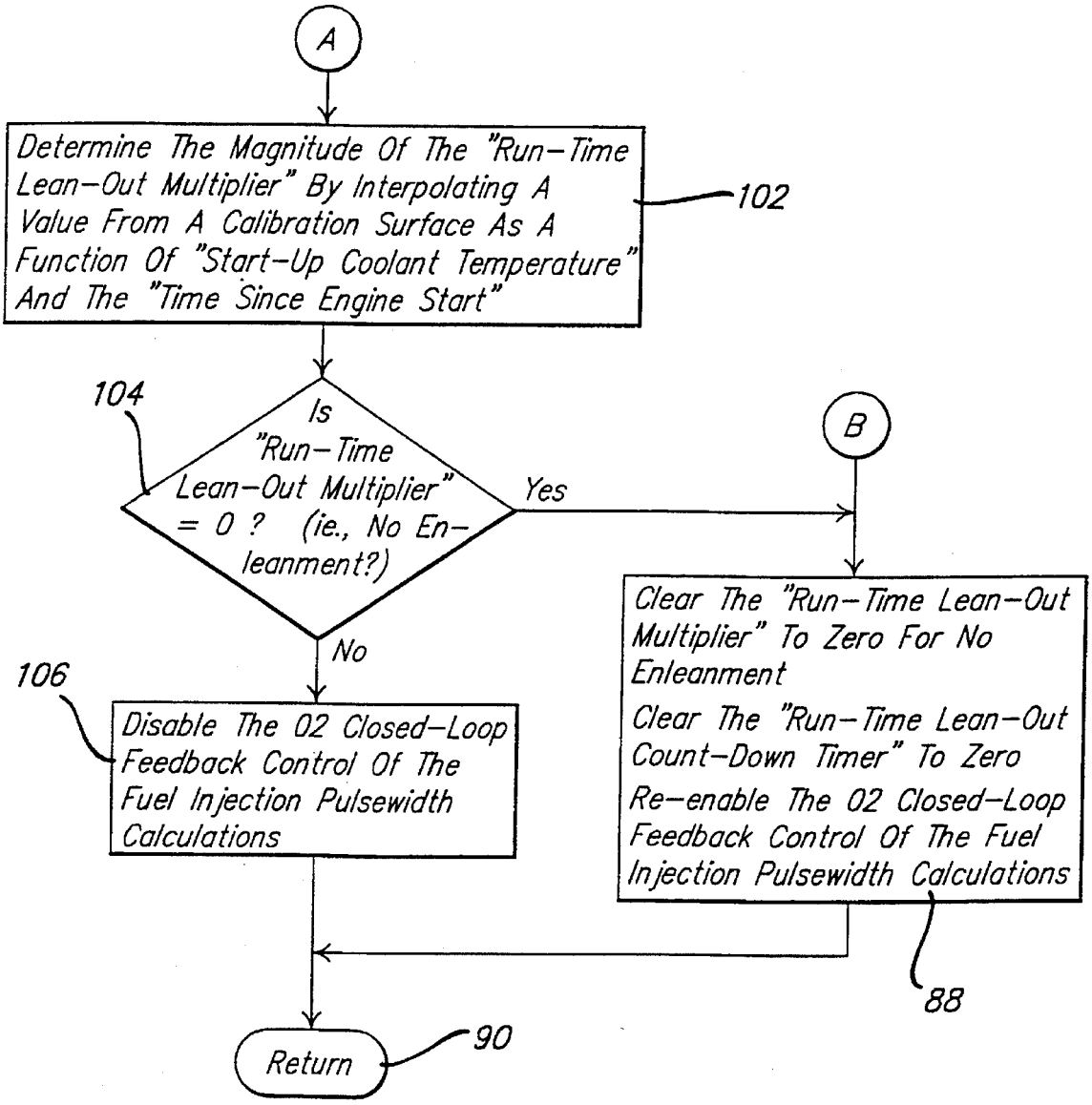

Referring to FIGS. 5 and 6, a method of catalyst purge fuel lean-out control, according to the present invention, is shown. The method causes the fuel/air charge mixture to be more lean during relatively severe engine deceleration events for a certain time immediately after a "cold" start of the engine 12. This is accomplished by calculating the catalyst purge fuel lean-out multiplier of block 58.

In block 58, the methodology advances to diamond 86 and determines whether the "time since engine start" is below a predetermined run-time lean-out maximum limit such as one hundred seventy-six (176) seconds. The engine controller 30 has a run-time counter (not shown) which counts the time since the engine 12 went through the start mode to the run mode or start-to-run transfer. If not, the methodology advances to block 88. In block 88, the methodology clears a run time lean-out multiplier to zero (0) for no enleanment and clears a run-time lean-out count-down timer of the engine controller 30 to zero (0). The methodology then re-enables an $O_2$ closed-loop feedback control of the fuel injectors of the engine 12 using the $O_2$ sensor 40. The methodology then advances to bubble 90 and returns to block 60 of FIG. 2.

In diamond 86, if the time since engine start is below the run-time lean-out maximum limit, the methodology advances to diamond 92 and determines whether the run-time lean-out count-down timer is greater than a predetermined value such as zero (0) (i.e., currently in a "run-time lean-out" event). The run-time lean-out timer must be greater than zero (0) signifying that run-time lean-out is currently activated. If the run-time lean-out count-down timer is not greater than zero (0), the methodology advances to diamond 94 and determines whether the engine 12 is in a "severe" throttle deceleration event based on the output signal from the throttle position sensor 34. If not, the methodology advances to block 88 previously described. If so, the methodology advances to block 96 and initializes the run-time lean-out count-down timer with a predetermined maximum duration value such as one hundred seventy-six (176) seconds.

After block 96 or if the run-time lean-out count-down timer is greater than zero (0) in diamond 92, the methodology advances to diamond 98 and determines whether the engine 12 is currently in either a throttle deceleration condition or a MAP deceleration condition based on the output signal from the throttle position sensor 34 and MAP sensor 36. If not, the methodology advances to block 88 previously described. If so, the methodology advances to diamond 100 and determines whether the current engine speed from the crankshaft sensor is above or greater than a predetermined idle set speed plus a calibratable offset stored in memory of the engine controller 30. If not, the methodology advances to block 88 previously described. If so, the methodology advances to block 102 and determines the magnitude of the run-time lean-out multiplier by interpolating a value from a calibration surface as a function of start-up or initial engine coolant temperature and the amount of elapsed time since the engine 12 transferred from the start mode to the run mode. The engine controller 30 determines the run-time lean-out multiplier value from a calibration surface stored in memory using the look-up parameters of initial engine coolant temperature from the coolant temperature sensor 32 and runtime counter in the engine controller 30.

After block 102, the methodology advances to diamond 104 and determines whether the run-time lean-out multiplier value is greater than a predetermined value such as zero (0) (i.e., no enleanment). If so, the methodology advances to block 88 previously described. If not, the methodology advances to block 106 and disables the $O_2$ closed loop feedback control of the fuel injectors of the engine 12. The methodology then advances to bubble 90 previously described. It should be appreciated that the run-time lean-out multiplier value is applied to the fuel pulsewidth value to reduce the amount of fuel injected by the fuel injectors into the engine 12.

Figure 7:
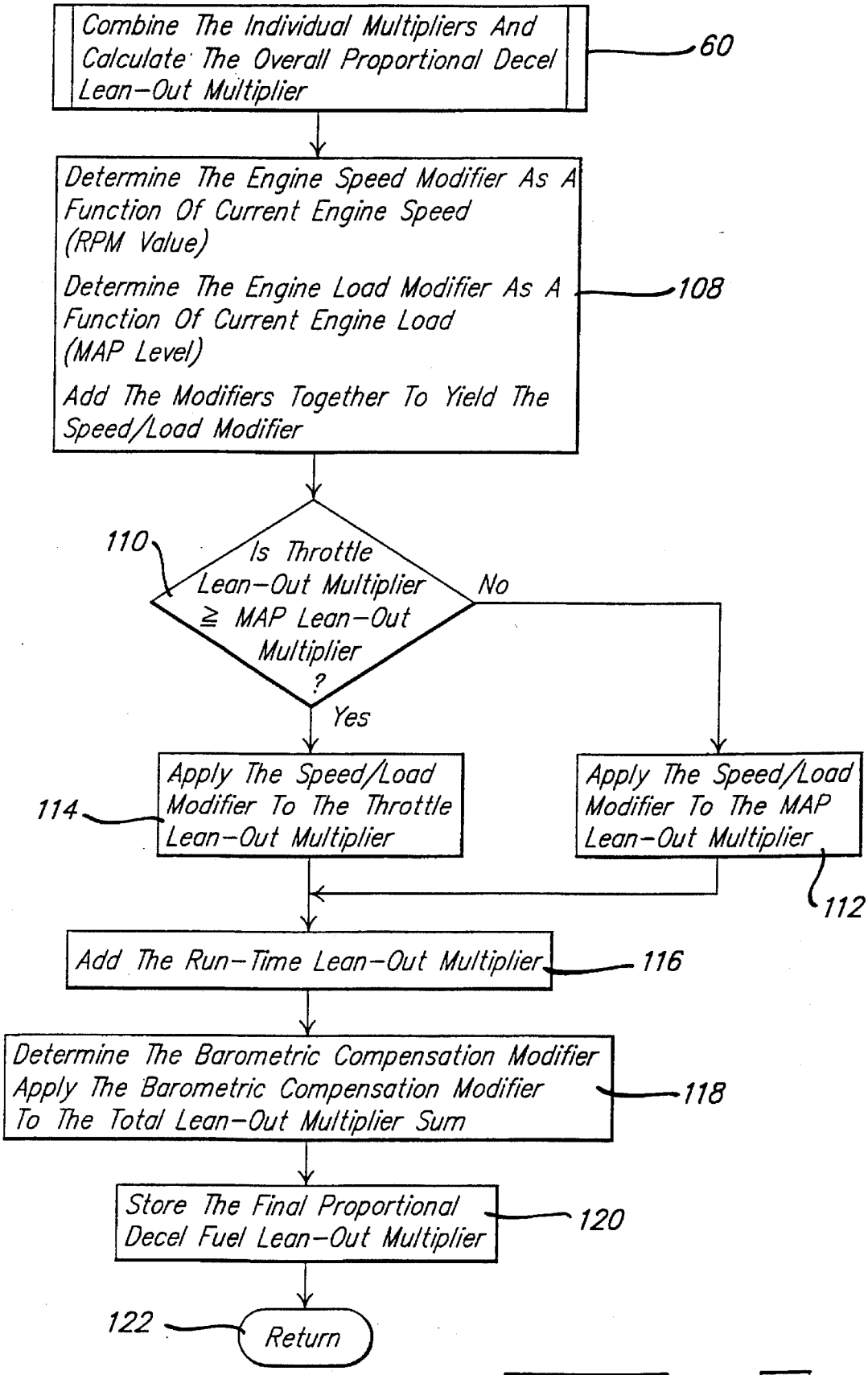

As illustrated in FIG. 7, a method of load and speed modifying on fuel lean-out, according to the present invention, is shown. The method modifies the amount of enrichment required by the engine 12 by a speed and load modifier to allow the engine 12 to remain at stoichiometric.

The method involves combining the individual above-described multipliers and calculating the overall proportional deceleration fuel lean-out multiplier value of block 60. In block 60, the methodology advances to block 108 and determines an engine speed modifier value as-a function of a current engine speed (RPM) value as sensed by the crankshaft sensor. The methodology also determines an engine load modifier value as a function of a current engine load (MAP level) as sensed by the MAP sensor 36. The methodology adds the engine speed modifier and engine load modifier values together to yield a speed/load modifier value. It should be appreciated that the speed/load modifier value modifies the amount of enrichment to allow the engine 12 to remain at stoichiometric.

After block 108, the methodology advances to diamond 110 and determines whether the predetermined throttle lean-out multiplier value is greater than or equal to the predetermined MAP lean-out multiplier value. If not, the methodology advances to block 112 and multiplies the MAP lean-out multiplier value by the speed/load modifier value. If so, the methodology advances to block 114 and multiplies the throttle lean-out multiplier value by the speed/load modifier value. After blocks 112 and 114, the methodology advances to block 116 and adds the run-time lean-out multiplier value to the value of either blocks 112 and 114. The methodology then advances to block 118 and determines a barometric compensation multiplier value by interpolating a value from a table stored in memory of the engine controller 30 using the barometric pressure from a sensor (not shown) as the independent variable. The methodology multiplies the total lean-out multiplier sum of block 116 by the barometric compensation modifier value. The methodology then advances to block 120 and stores the final proportional deceleration fuel lean-out multiplier value of block 118. The methodology then advances to bubble 122 and returns to block 62 of FIG. 2. It should be appreciated that the final proportional deceleration fuel lean-out multiplier value is applied to the fuel pulsewidth value to reduce the amount of fuel injected by the fuel injectors into the engine 12.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of load and speed modifying on declaration fuel lean-out for an internal combustion engine, said method comprising the steps of:

determining if conditions are right for executing said method and continuing said method if the conditions are right;

sensing a speed of the engine;

determining an engine speed modifier as a function of current sensed engine speed;

sensing a manifold absolute pressure (MAP) of an intake manifold of the engine;

determining an engine load modifier as a function of current sensed MAP;

adding the determined engine speed modifier and engine load modifier together to yield a speed/load modifier; and applying the speed/load modifier value to a fuel pulsewidth value of fuel injectors for the engine and reducing the amount of fuel injected into the engine by the fuel injectors.

2. A method of load and speed modifying on fuel lean-out for an internal combustion engine, said method comprising the steps of:

sensing a speed of the engine;

determining an engine speed modifier as a function of current sensed engine speed;

sensing a manifold absolute pressure (MAP) of an intake manifold of the engine;

determining an engine load modifier as a function of current sensed MAP;

adding the determined engine speed modifier and engine load modifier together to yield a speed/load modifier; and determining whether a throttle lean-out multiplier value is greater than or equal to a MAP lean-out multiplier; and applying the speed/load modifier value to a fuel pulsewidth value of fuel injectors for the engine and reducing the amount of fuel injected into the engine by the fuel injectors.

3. A method as set forth in claim 2 including the step of applying the speed/load modifier to the throttle lean-out multiplier value if the throttle lean-out multiplier value is greater than or equal to the MAP lean-out multiplier value.

4. A method as set forth in claim 2 including the step of applying the speed/load modifier to the MAP lean-out multiplier value if the throttle lean-out multiplier value is not greater than or equal to the MAP lean-out multiplier value.

5. A method as set forth in claim 2 including the step of calculating a final proportional deceleration fuel lean-out multiplier based on the throttle lean-out multiplier and MAP lean-out multiplier values.

6. A method of load and speed modifying on fuel lean-out for an internal combustion engine, said method comprising the steps of:

sensing a speed of the engine;

determining an engine speed modifier as a function of current sensed engine speed;

sensing a manifold absolute pressure (MAP) of an intake manifold of the engine;

determining an engine load modifier as a function of current sensed MAP;

adding the determined engine speed modifier and engine load modifier together to yield a speed/load modifier;

determining whether a throttle lean-out multiplier value is greater than or equal to a MAP lean-out multiplier;

applying the speed/load modifier to the throttle lean-out multiplier value if the throttle lean-out multiplier value is greater than or equal to the MAP lean-out multiplier value;

applying the speed/load modifier to the MAP lean-out multiplier value if the throttle lean-out multiplier value is not greater than or equal to the MAP lean-out multiplier value;

calculating a final proportional deceleration fuel lean-out multiplier based on the throttle lean-out multiplier and MAP lean-out multiplier values; and applying the calculated final proportional deceleration fuel lean-out multiplier value to a fuel pulsewidth value of fuel injectors for the engine and reducing the amount of fuel injected into the engine by the fuel injectors.

* * * * *